US005666425A

United States Patent [19]

Sibbald et al.

[11] Patent Number: 5,666,425

[45] Date of Patent: Sep. 9, 1997

[54] PLURAL-CHANNEL SOUND PROCESSING

[75] Inventors: Alastair Sibbald, Maidenhead; Richard David Clemow, Gerrards Cross; Adam Philp, Ealing; Fawad Nackvi, Southall; Adrian Miles Sandford, Hawley, all of England

[73] Assignee: Central Research Laboratories Limited, Hayes, England

[21] Appl. No.: 507,437

[22] PCT Filed: Feb. 23, 1994

[86] PCT No.: PCT/GB94/00350

§ 371 Date: Mar. 20, 1996

§ 102(e) Date: Mar. 20, 1996

[87] PCT Pub. No.: WO94/22278

PCT Pub. Date: Sep. 29, 1994

[30] Foreign Application Priority Data

Mar. 18, 1993 [GB] United Kingdom ..... 9305583
Apr. 23, 1993 [GB] United Kingdom ..... 9308509

[51] Int. Cl.[6] ..... H04R 5/00

[52] U.S. Cl. ..... 381/26; 381/1; 381/24

[58] Field of Search ..... 381/26, 25, 74, 381/1, 17, 18, 19, 20, 21, 22, 23, 24

[56] References Cited

U.S. PATENT DOCUMENTS 3,236,949 2/1966 Atal et al. .
4,096,353 6/1978 Bauer ..... 381/21
4,910,779 3/1990 Cooper et al. ..... 381/1
5,034,983 7/1991 Cooper et al. ..... 381/25
5,173,944 12/1992 Begault ..... 381/26

FOREIGN PATENT DOCUMENTS 9208988 10/1992 Germany .
0219400 8/1990 Japan .
8903632 4/1989 WIPO .

*Primary Examiner*—Minsun Oh
*Attorney, Agent, or Firm*—Keck, Mahin & Cate

[57] ABSTRACT

An artificial head (2) and a plurality of discrete monophonic microphones (8, 10, 12) are used to record one or more sound sources. The signals (14, 16, 18) from each of the microphones (8, 10, 12) then undergo binaural synthesis based upon acoustical properties of a real human head or the artificial head (2), and the signals (4, 6) from the head are equalised using air-to-ear transfer functions of the artificial head (2) or a real head. The resultant signals are combined by summing the individual left (48) and right (50) channels together and then these summed signals (52, 54) are transaural crosstalk compensated (56) to provide final left and right channel signals (58, 60) suitable for recording or playback which provide a three-dimensional sound effect to a listener both via headphones and loudspeakers.

15 Claims, 6 Drawing Sheets

PLURAL-CHANNEL SOUND PROCESSING

The present invention relates to a plural-channel sound processing system and has particular, although not exclusive, relevance to such systems as may be used to record music for playback via two loudspeakers.

The principles of sound recording such that, on playback via two spaced sound sources, a stereophonic effect is perceived have long been known. One of the commonest forms of stereophonic sound recording involves using a stereo microphone pair, with the microphones spaced-apart by a distance approximately equal to one head width. This produces an effect of being able to partially reproduce the acoustic image recorded owing to the different arrival times of various sounds between the microphone pair, owing to their separation.

The above technique is far from satisfactory, however, and attempted improvements in stereo recording often utilised a so-called artificial head. This is an artificial lifesize head (and optionally) torso in which a pair of microphones are mounted either in substitution of the ear canals, or incorporated into simulated ear canals. The external ear parts are reproduced according to mean human dimensions and are manufactured from silicone rubber or similar material such that the sounds which the microphones record have been acoustically modified by the artificial head and ears so as to possess all of the natural sound localisation cues used by the brain. Such recording techniques have become known as binaural recordings and an example of one such technique is disclosed in, for example, U.S. Pat. No. 4,910,779.

Such artificial head recording techniques are known to possess remarkable acoustical properties when listened to via headphones. Sounds may be perceived as emanating from outside the listener's head, rather than inside it as with conventional stereophonic recordings which are listened to via headphones, and may also be perceived in three dimensions—even above and behind the listener's head.

There also exist many problems associated with artificial head recordings. For example, it is known that the tonal qualities of binaural recordings are not true to life. This is due to the fact that sounds pass, effectively, through two sets of ears; those of the artificial head during recording, and those of the listener during playback. There is generally a resonance associated with the main cavity in the external ear (the coneha) which occurs at a frequency of several kHz and boosts the mid-range gain of the recording and hence as a consequence of passing through the second set of ears during playback this effect is exacerbated and the sounds appear to lack both low-frequency and high-frequency content.

In order to compensate for this "twice-through-the-ears" effect it is known to use audio filters to shape, or equalise, the spectral response of the sound recorded via the artificial head. The transfer function used for this shaping has been calculated in the prior art in many different ways and confusion seems to exist over which way is the best way to equalise the artificial head recordings. Some practitioners use headphone-to-ear transfer functions, yet these functions will differ from one headphone type to another. Some practitioners use loudspeaker-to-ear transfer functions—here the functions are dependent both upon the angle of incidence of the sound from the loudspeaker to the ear and the distance from the head to the loudspeaker. Other practitioners measure transfer functions under both free-field (anechoic) and diffuse-field (echoic) conditions and then compensate according to either the headphone-to-ear or loudspeaker-to-ear requirements.

When playback of a binaurally recorded sound via loudspeakers occurs, it is known that a further important correction factor is needed. This is known as transaural crosstalk compensation and is also described in the acknowledged prior art. This correction factor essentially compensates for sound detected by the left ear originating from a loudspeaker nearer to the right ear and vice versa. An example of this well-known technique is disclosed in U.S. Pat. No. 3,236,949.

When making binaural sound recordings using an artificial head, the head is often set up so as to be in a central position in relation to the sounds which are to be recorded. In an example of recording an orchestra, the head will often be situated adjacent the conductor so that it can pick up most instruments with relative ease. However, this set up does not enable the artificial head to "focus" on one type of instrument, or sound, say the timpani. If the artificial head were moved nearer to the timpani section, then sound from some other instruments would not be recorded so well and the sound balance would be degraded.

It is thus an object of one aspect of the present invention to make possible binaural sound recording using not only an artificial head but also at least one further microphone. Furthermore such recording should also be able to be played back via headphones and via loudspeakers and in either circumstance still possess the perceived binaural qualities without any need for modification or adaptation of conventional audio playback equipment.

Thus according to a first aspect of the present invention there is provided a plural-channel sound processing system including:

- an artificial head having microphones in each ear for providing left and right first channel signals representative of sound received by the microphones;
- at least one further microphone spaced from the artificial head for providing monophonic further signals representative of sound received thereby;
- and a signal processor for: modifying the fast signals in accordance with air-to-ear transfer functions of the artificial head to produce left and right auxiliary first channel signals; time-delaying the further signals from the or each further microphone in dependence upon the displacement of the or each further microphone from the artificial head; performing binaural synthesis on the time-delayed further signals to produce left and right channel auxiliary further signals; combining the resulting left and right auxiliary first and auxiliary further signals: and transaural crosstalk compensating the respective combined signals to produce left and right channel processed signals.

Thus by provision of both an artificial head and at least one further microphone, both of which produce signals which are processed to exhibit binaural characteristics and which are both subjected to transaural crosstalk compensation, a signal for recording or transmission can be produced which, when played back via headphones and via loudspeakers, in either circumstance provides an apparently three dimensional sound image to a listener.

According to a further aspect of the present invention there is provided a plural-channel sound processing system including:

- an artificial head having microphones in each ear for providing left and right first channel signals representative of sound received by the microphones;
- at least one further microphone spaced from the artificial head for providing monophonic further signals representative of sound received thereby;

and a signal processor for: time delaying the further signals from the or each further microphone in dependence upon the displacement of the or each further microphone from the artificial head; performing binaural synthesis on the time-delayed further signals to produce left and right channel auxiliary further signals; combining the left and right channel first and auxiliary further signals; modifying the combined signals in accordance with air-to-ear transfer functions of the artificial head; and transaural crosstalk compensating the respective modified signals to produce left and right channel processed signals.

Preferably the displacement of the or each further microphone from the artificial head comprises the distance from and the azimuthal and elevation angles to a point on a centre line through the head centrally between the ears whilst the head is in a predetermined orientation. Measurement of these parameters provides the necessary signal processing information to enable the signals from the or each further microphone to take on binaural recording properties by use of a particular binaural synthesis filter.

Preferably the combining of the resultant first and further signals is achieved individually for the left and right channel signal components.

According to a yet another aspect of the present invention there is provided a method of plural-channel sound processing including:

providing, from an artificial head, left and right first channel signals representative of sound received by the head, providing, from at least one microphone spaced from the head, monophonic further signals representative of sound received thereby;

modifying the first signals in accordance with air-to-ear transfer functions of the artificial head to produce left and right auxiliary first channel signals;

time-delaying the further signals from the or each microphone in dependence upon the displacement of the or each microphone from the artificial head;

performing binaural synthesis on the time-delayed further signals to produce left and right channel auxiliary further signals;

combining the resulting left and right auxiliary first and auxiliary further signals;

and transaural crosstalk compensating the respective combined signals to produce left and right channel processed signals.

According to a further aspect of the present invention there is provided a method of plural-channel sound processing including:

providing, from an artificial head, left and right channel first channel signals representative of sound received by the head;

providing, from at least one microphone spaced from the head, monophonic further signals representative of sound received thereby;

time-delaying the further signals from the or each microphone in dependence upon the displacement of the or each microphone from the artificial head;

performing binaural synthesis on the time-delayed further signals to produce left and right channel auxiliary further signals;

combining the left and right channel first and auxiliary further signals;

modifying the combined signals in accordance with air-to-ear transfer functions of the artificial head;

and transaural crosstalk compensating the respective modified signals to produce left and right channel processed signals.

The invention will now be described, by way of example only, and with reference to the accompanying drawings, of which, FIG. 1 shows a block diagram of a two-channel sound recording system in accordance with the present invention;

Figure 1:
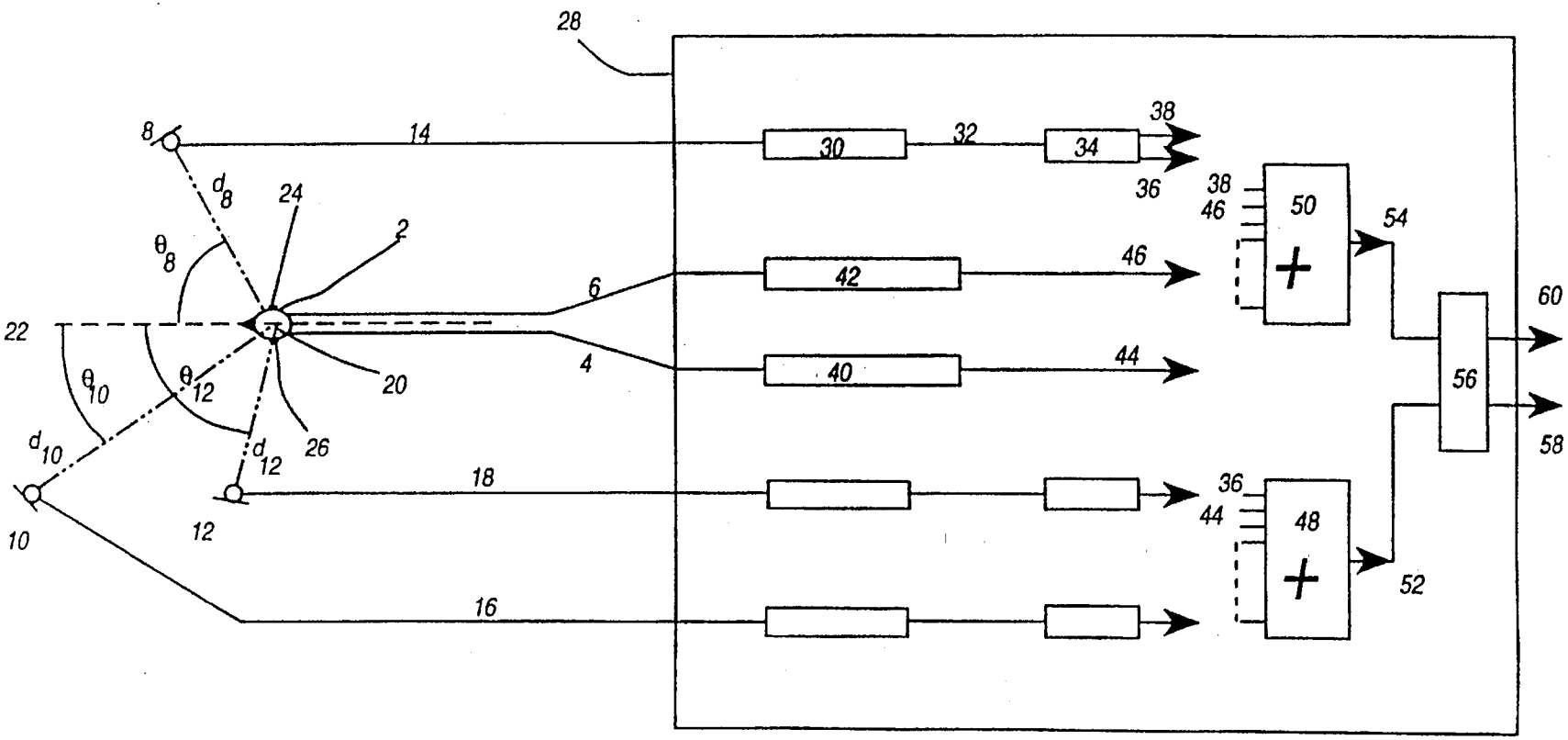

Referring firstly to FIG. 1 it will be seen that a two-channel sound recording system includes an artificial head 2 which has in each simulated ear canal thereof a microphone (not shown). (In some artificial head arrangements, the microphone is mounted directly in lieu of the entire canal). Each microphone produces signals 4,6 (left and right channels) indicative of sounds received thereby. Spaced from the head 2 is at least one further microphone, in this example three further microphones 8,10,12. Each further microphone 8,10,12 provides a respective monophonic further signal 14,16,18 also indicative of sound received thereby.

It can be seen that the microphones 8,10,12 are spaced from the head 2 by known distances—respectively $d_8$, $d_{10}$ and $d_{12}$. Also, each microphone 8,10,12 is at an azimuthal angle to a point 20 at the head, which point lies on a centre line 22 through the head 2 and directly between the two ears 24,26. These angles are, respectively, for each of the microphones 8, 10 and 12; $\theta_8$, $\theta_{10}$ and $\theta_{12}$. Furthermore each microphone 8,10,12 is at an angle of elevation (this term naturally includes depression) to the head given respectively by $\phi_8$, $\phi_{10}$ and $\phi_{12}$; however as these angles effectively lie perpendicular the plane of the drawing they cannot be shown diagrammatically.

From hereon, for reasons of clarity, the signals derived from only one of the three further microphones, 8, will be described. It will be apparent that such description is also relevant to the output signals from each of the other microphones 10 and 12, yet such further description may only confuse understanding of the invention and so will be omitted for ease of comprehension only.

The output 14 of microphone 8 passes to a signal processor shown generally as 28. Also passed to the signal processor 28 is each head 2 output 4 and 6.

The output 14 of microphone 8 is passed to time delay 30 wherein the signal 14 is delayed by a time $\tau_8$ which depends on the time-of-flight associated with the acoustic path distance between microphone 8 and the head 2. This delay is calculated in a known manner by utilising the distance $d_8$. The delay 30 also adds to the signal 14 a padding delay of several milliseconds, for reasons which will be explained below.

The delayed and padded signal 32 is then passed to a filter 34 which performs binaural synthesis on signal 32.

This filter 34 corresponds to the so-called head response transfer functions and the inter-aural time delays associated with both the azimuthal angle $\theta_8$ and elevation angle $\phi_8$ of microphone 8. When a sound wave is incident on the head from a particular direction, it passes into both left and right auditory canals via a plurality of diffraction and reflection pathways around the head itself and associated with the resonances of external parts of the ear. The effects of this are that (a) there is a "time-of-arrival" difference between left and right ears, dependent on source position, typically between 0 and 760 μs; and (b) a great deal of spectral shaping occurs, which is also source position dependent. With a detailed knowledge of such processes filter pairs can be devised which, when both are fed in parallel with a signal, modify the signal so as to confer the respective left and right spectral shaping, together with an appropriate differential time delay, and cause the resultant signal to possess the perceived acoustic properties of a binaural source having the corresponding direction. Filter 34 is constituted by such a filter pair.

The binaural synthesis performed on signal 32 thus imparts to the input monophonic signal binaural properlies and so the output of the filter 34 are left 36 and right 38 auxiliary further channel signals having perceived acoustic properties similar to those of the head 2 outputs 4,6. Referring now to the output signals 4,6 of head 2, it can be seen that the left channel 4 is supplied to a further filter 40 and the right channel 6 is passed to a further filter 42. Each filter 40,42 modifies its input signal 4,6 respectively in accordance with an air-to-ear transfer function for that particular ear for the artificial head (or real head, if the transfer functions derive from measurements on a real head). The characteristic of each filter 40,42 is in fact the inverse of the relevant transfer function. The reason for this, as explained hereabove, is to eliminate the "twice through the ears" effect which would otherwise be manifest. The outputs of the filters 40,42 are so-called equalised left 44 and right 46 channel signals. (The chosen air-to-ear transfer function is typically that of $\theta=30°$; $\phi=0$, and is usually identical for left channel and right channel signals. Other values could be chosen for specific circumstances, for example, when closely spaced (±10°) television loudspeakers are to be used).

In the description herebefore it has been stated that the delay 30 imparts to the signal 14, inter alia, a padding delay of several milliseconds. The need for this padding delay is twofold: firstly, to incorporate a small time delay which corresponds to the acoustic path distance differences between (a) the source, e.g. a musical instrument, producing the sound to be recorded and the local microphone, and (b) the source producing the sound to be recorded and the artificial head; and secondly to ensure that the sounds from the additional microphone are rendered distinctly after the same sounds via the artificial head, such that brain of the listener always localises the sound source from the latter, with the former reinforcing the latter by means of the known Haas effect.

The resulting left channel signals 36 and 44 are now simultaneously applied to a in this example adder 48, similarly the resulting right channel signals 38 and 46 are simultaneously applied to adder 50. The adders 48 and 50 combine together the resulting signals applied thereto. In the example given above in which three microphones 8,10,12 were described, then each adder 48,50 will have one input derived from the head 2 and one derived from each microphone 8,10,12. The output of each adder 48,50 is, respectively, a left channel combined signal 52 and a right channel combined signal 54. The signals 52,54 are then input into a transaural crosstalk compensator 56 which provides compensated left 58 and right 60 channels suitable for transmission or recording in any suitable conventional manner, including magnetic tape (both digital and analogue), and recordable-compact disc. By reference now also to FIG. 2, the principle of the transaural crosstalk compensation performed by compensation 56 will be described.

The left 52 and right 54 signals are shown at the top of the figure and pass down through the figure to ultimately provide signals 57 and 59 which, as well as being suitable for recording, may also be used directly to drive loudspeakers 58 and 60 respectively as shown in this figure to illustrate the concepts of transaural crosstalk compensation. A listener 62 is situated on a central axis X—$X^1$ will hear signals from loudspeakers 58 and 60. The listener's left ear will hear signal 57 via transfer function S directly from the left loudspeaker 58, and also via transfer function A, diffracted around his head (more) in his right ear and temporally delayed because of the longer source-to-ear distance, also from loudspeaker 58. Similarly the listener will hear signal 59 via transfer function S directly in his right ear from loudspeaker 60 and via transfer function A, diffracted around his head and temporally delayed, in his left ear. This is clearly illustrated at the foot of FIG. 2. Thus the transmission function from a loudspeaker to the ear on the same side of the central axis X—$X^1$ is S, and to the ear on the opposite side of the central axis is A.

It is a conventional assumption that loudspeakers 58,60 for stereophonic listening will be placed so as to subtend angles of 30° with respect to the vertex of the triangle they form with the listener (situated at the apex), and hence A and S can be established, in known manner, by direct measurement, either from the artificial head 2, or by using measurements from a real human head. A and S are the left- and right-ear head response transfer functions for a source in the horizontal plane subtending an azimuth angle of 30° (e.g. loudspeaker 60 in FIG. 2). As noted previously, however, head response transfer functions which correspond to alternative angles might be chosen for particular applications, such as closely-spaced (±10°) television loudspeakers.

Figure 2:
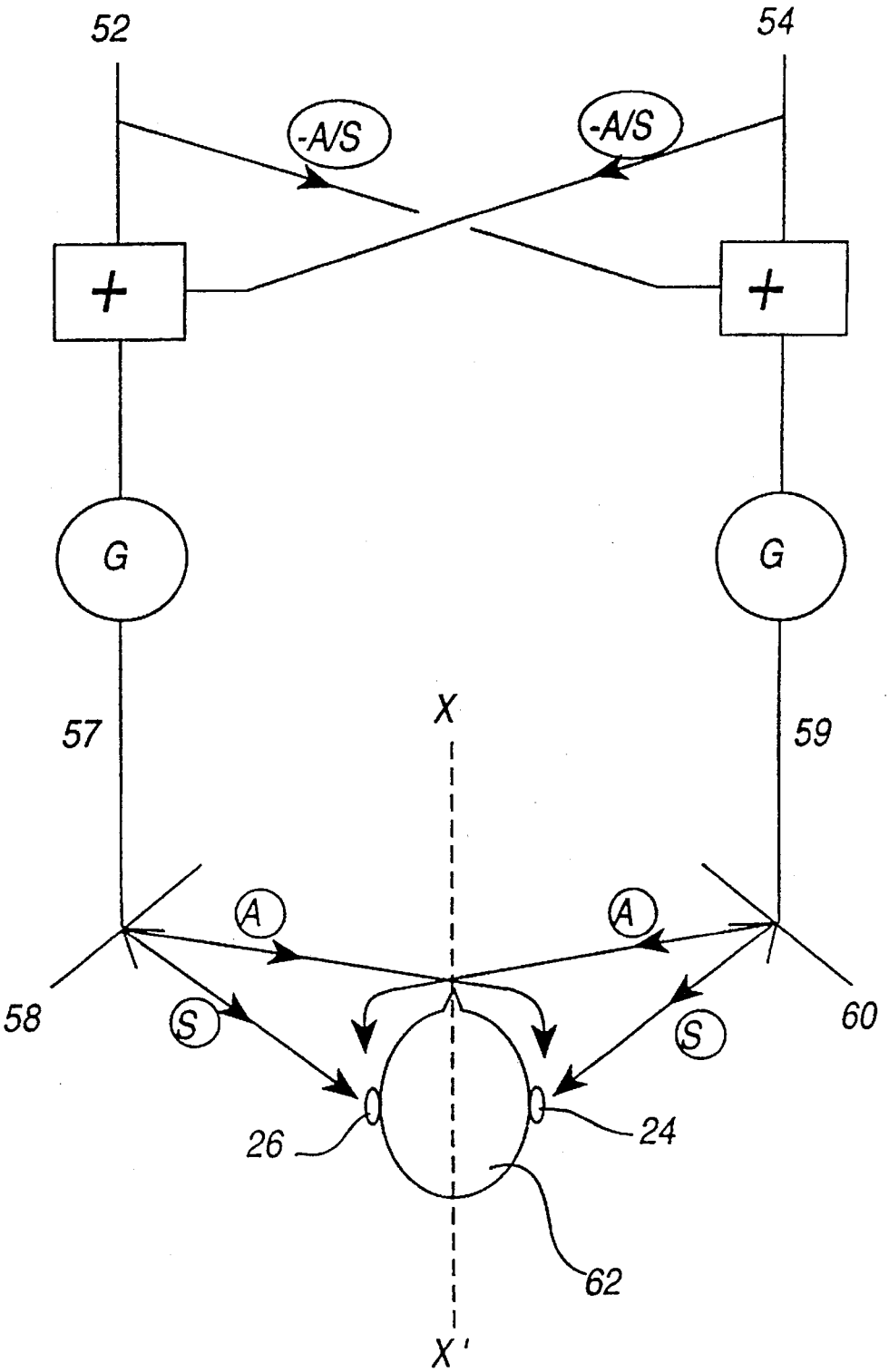
FIG. 2 shows schematically the concept of crosstalk compensation.
Figure 3A:
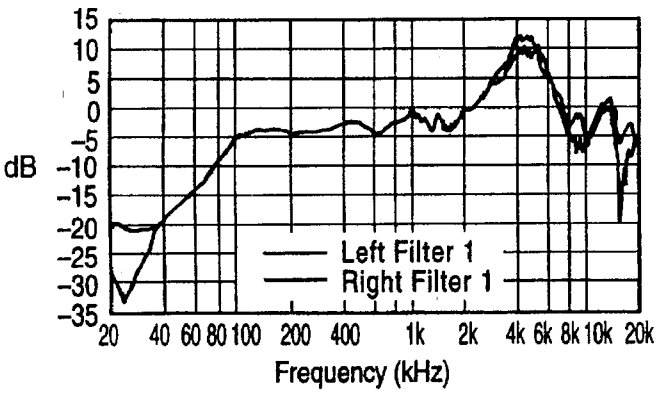
FIG. 3 illustrates various typical air-to-ear transfer functions for an artificial head representative of those which could be used in the present invention; and, FIGS. 4 and 5 each show alternative arrangements to the system of FIG. 1.
Figure 3B:
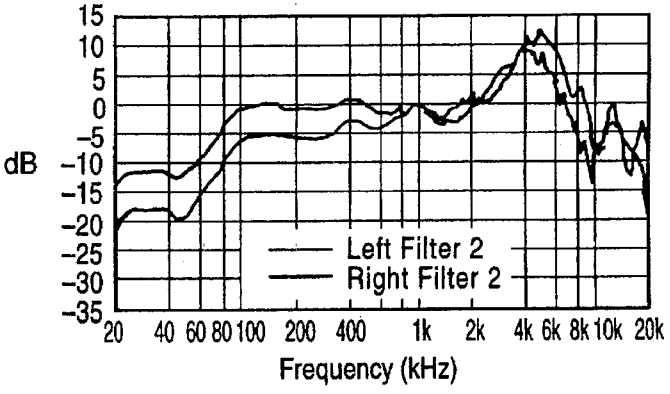
Figure 3C:
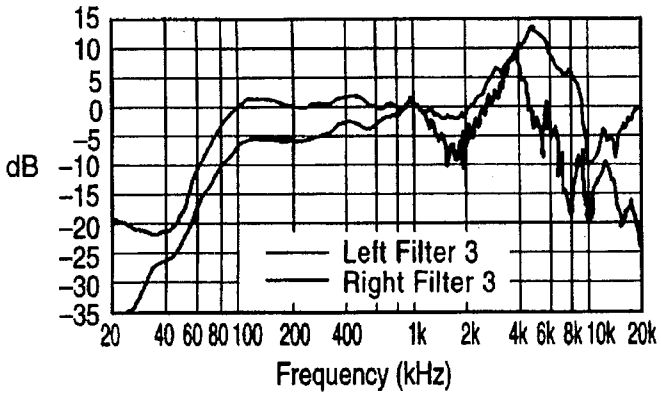
Figure 3D:
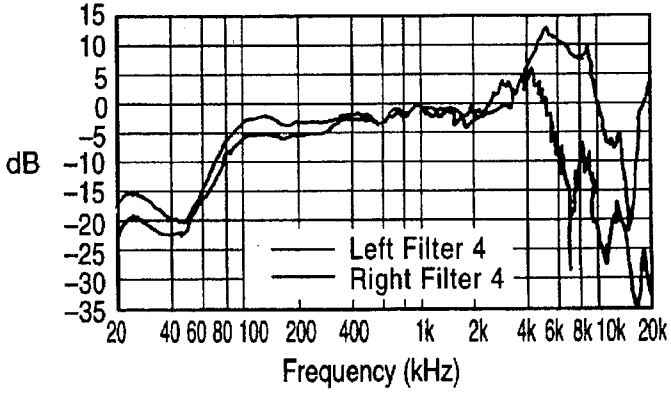
Figure 3E:
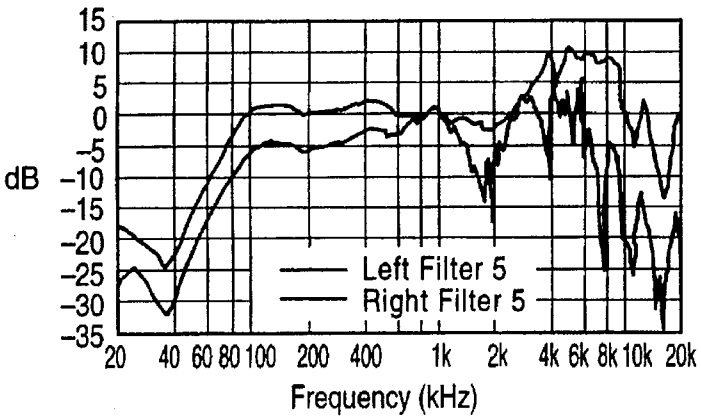
Figure 3F:
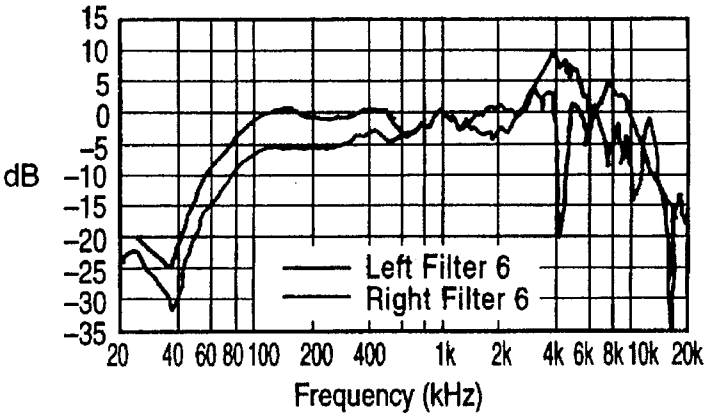
Figure 3G:
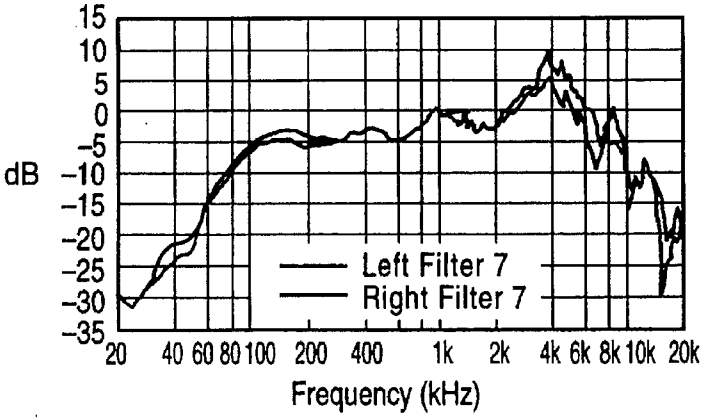

By inspection of the lower part of FIG. 2, it will be evident that, ordinarily, in a conventional stereophonic reproduction system, the right channel signal 59 is conveyed to the right ear 24 via transmission function S, and also to the left ear 26 as a crosstalk signal via transmission function A. Using the notation $X_y$ for signals received at the ears, where X represents the source channel and y represents which ear (right or left) is under consideration, then this can be represented as:

$$R_r=S \text{ and } R_1=A \tag{1}$$

In order to convey the signals to the listener without the crosstalk component, then the following must obtain:

$$R_r=S \text{ and } R_1=O \tag{2}$$

In order to implement this, firstly in respect of the right channel signal 54, and as is shown in the upper part of FIG. 2, a cancellation signal equal to the inverse of the crosstalk component, A, must be introduced into the opposite (left) channel, and, because it undergoes subsequent modification by transfer function S between loudspeaker 58 and left ear 26, this must be anticipated and countered by the inclusion of a 1/S term in the crossfeed filter, hence the crossfeed filter has the function (−A/S).

However, the cancellation signal of each of the loudspeakers 58,60 itself "crosstalks" to the opposite ear, and so this too must be cancelled, and so on. By introducing a serial filter, G, as shown, and ascertaining a function for G so as to satisfy the conditions of (2), then G can be created so as to deal with the multiple cancellation requirement. More particularly, the overall transmission function R from the right 54 signal to the right ear 24 of listener 62 should be equal to S:

$$R_r = GS + (-A/S)GA = S \quad (3)$$

The overall transmission function from the right 54 signal to the left ear 26 of the listener, is equal to 0, whatever the value of G:

$$R_r = GA + (-A/S)GS = ) O \quad (4)$$

By solving (3) for G in terms of A and S, it can be shown that:

$$G = \frac{1}{\left(1 - \frac{A^2}{S^2}\right)} \quad (5)$$

Hence by constructing the compensator 56 of FIG. 1 to perform the functions described with reference to FIG. 2 the transaural crosstalk compensated signals 57 and 59 comprise left and right channel signals which are suitable either to directly drive loudspeakers or headphones or are suitable to be recorded conventionally and later reproduced in known manner.

It is also known that transaural crosstalk cancellation means can be devised so as to include equalization, for example, of the sounds originating from loudspeakers at any given angle, such as ±30°. This is achieved by solving equation (2) for unity and zero (rather than S and zero) thus:

$$R_r = 1 \text{ and } R_1 = 0 \quad (6)$$

Accordingly, a combined equalization and crosstalk cancellation scheme could be configured, if so desired, which could be used to implement items 42,40 and 56 of FIG. 4 (to be described below), and components 72,68 and 56 of FIG. 5 (and also items 70 and 66 if desired). Combined processing such as this could be implemented in a more compact, albeit less flexible, manner.

It should be noted that the binaural synthesis performed on signal 32 by filter 34 is actually a normalised binaural synthesis. This means that the synthesis utilises the air-to-ear transfer function pair for a particular direction ($\theta_8$,$\phi_8$) divided by the corresponding air-to-ear transfer function pair for frontal sound incidence (i.e. $\theta$=0 and $\phi$=0). Reference now also to FIG. 3 illustrates the various air-to-ear transfer function pairs ("pair" because the head 2 has a pair of ears) for various angles of incident sound in the horizontal plane. 0° incidence means that the sound source is directly in front of the head and 90° incidence means that the sound source is on one side (the right) of the head 2 lying on a line drawn straight through both ears, etc.

It will be appreciated that the normalised binaural synthesised signals 36,38 do not possess the gross mid-range boost properties cause by the resonance of the concha and are thus suitable for mixing directly with appropriately equalised signals 44,46 from the head 2 in the adders 48,50.

Figure 4:
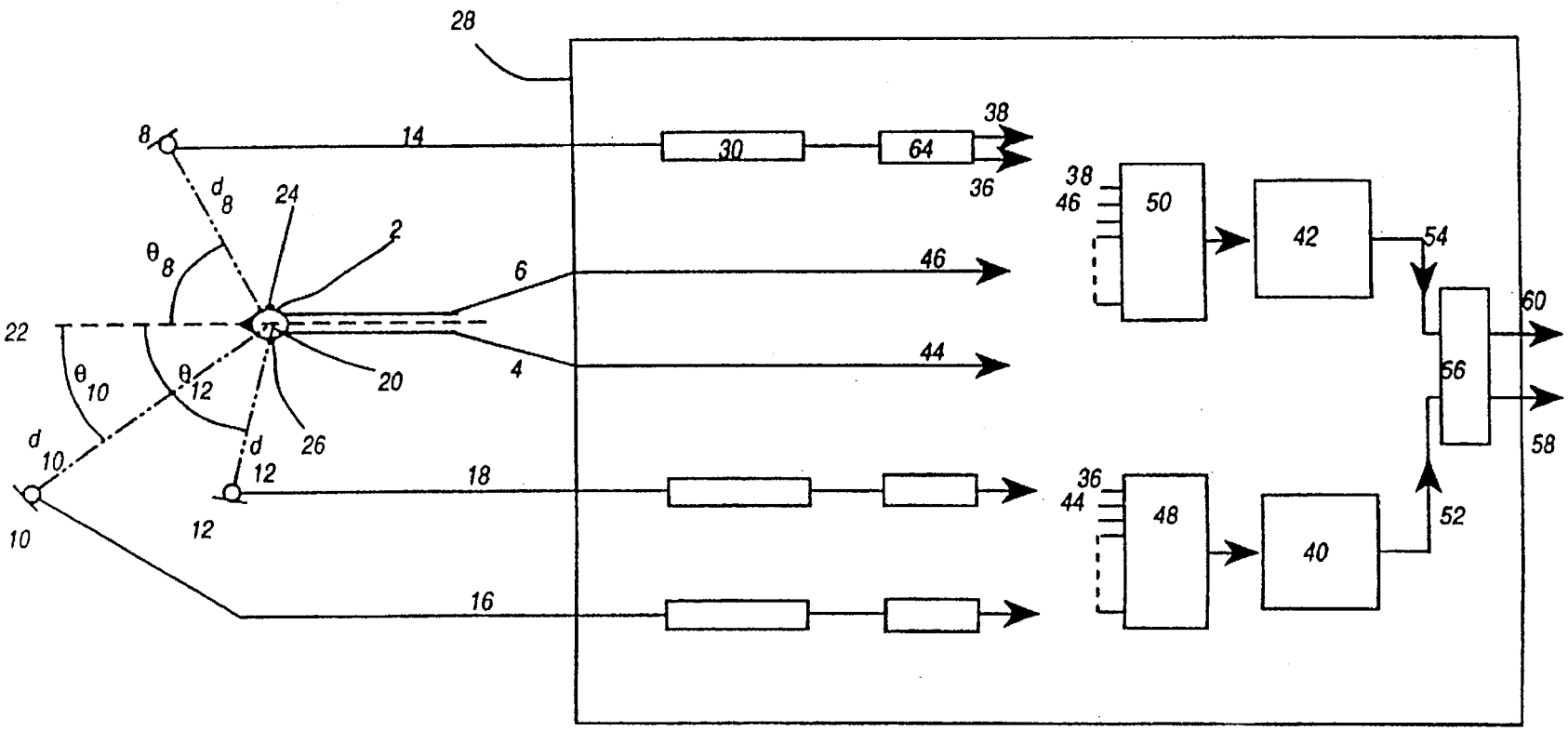

Referring now to FIG. 4, which shows an alternative embodiment to that of FIG. 1 and so like components are correspondingly numbered, it can be seen that equalisation bf the signals 4,6 derived from the head 2 is not performed until after summation in adders 48,50. Also it can be seen that the time-delayed signals 32 are passed to a filter 64 which performs an ordinary, i.e. not normalised, binaural synthesis thereupon. Clearly the normalisation is not necessary in this particular case as the equalisation performed subsequently by the filter 40,42 imparts the necessary tonal correction to the binaurally synthesised signals 38,36 by suitable choice of the air-to-ear transfer functions as described hereabove and with reference also to FIG. 3. Also, of course, the equalising filters 40,42 equalise the unequalised artificial head 2 components present in signals 51,53 derived from adders 48,50 using the above-mentioned 1/S signal and then pass the equalised signals 52,54 on to the transaural crosstalk compensator 56 as described before but without incorporated 1/S functions.

Figure 5:
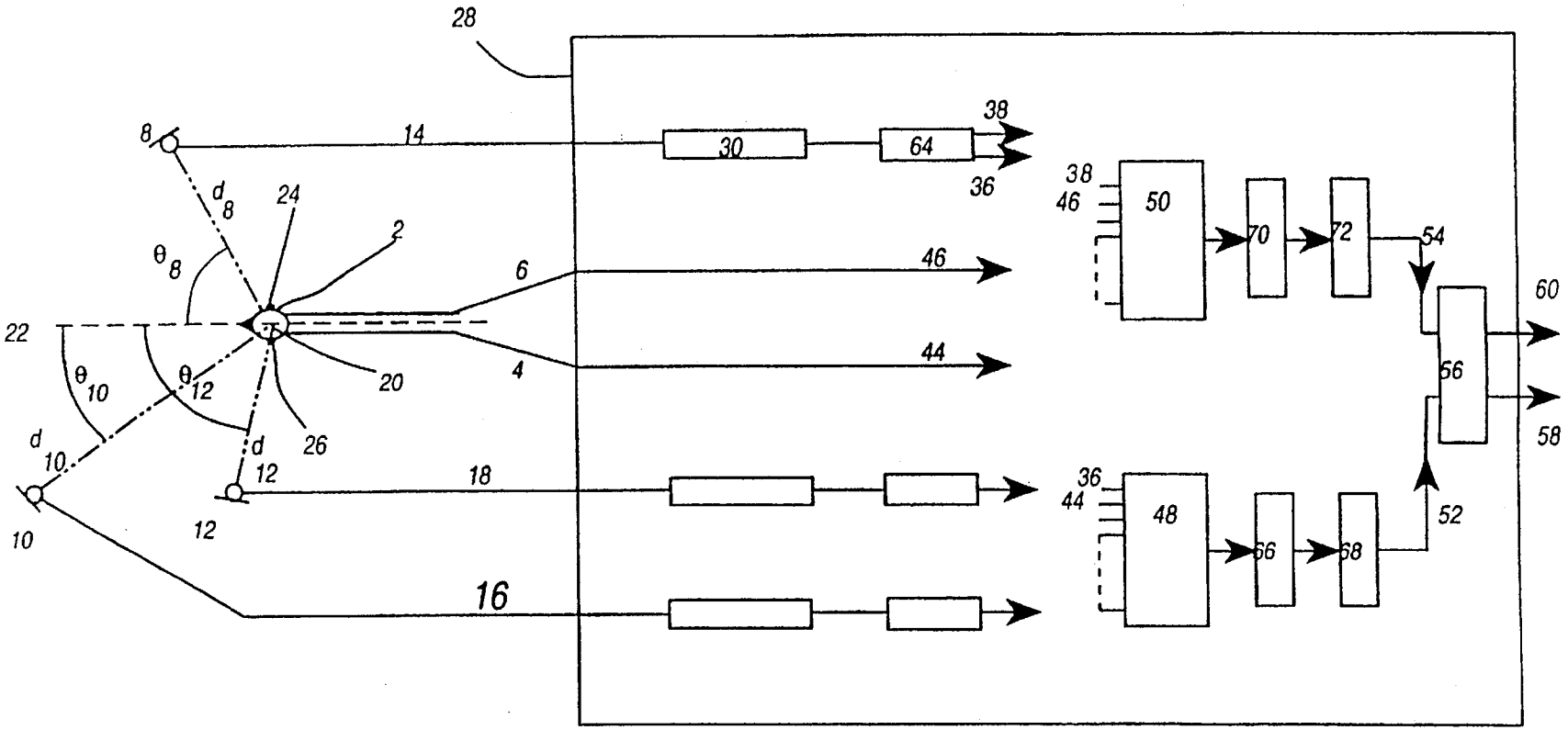

A further modification of the FIG. 4 embodiment is illustrated in FIG. 5 where it can be seen that the equalising filters 40,42 have been divided such that two filters 66,68 equalise the left channel signals 51 and two filter banks 70,72 equalise the right channel signals 53. This permits custom equalisation arrangements to be possible. For example, if a classical music recording were being made, the equalisation might desirably be different to that of a jazz or pop music recording.

It will be apparent that in relation to the foregoing description, the individual microphone 8,10,12 signals 14,16,18 could be equalised in-line prior to their input into the processing system. The only changes which would then need to be made would be that any associated time-delays introduced by such processing should be taken into account, and time delay elements 30 adjusted accordingly.

Those skilled in the art will appreciate that, in the foregoing, the choice of which particular air-to-ear transfer function, as illustrated in FIG. 3, is to be chosen will be dictated by the particular circumstances of the recording to be made. For example, if the recording is intended to be played back via headphones, which generally cup around the listener's ears, then the 90° air-to-ear transfer functions will be used in order to equalise the signals provided. However, in the above example, the recording is desired to be primarily played back via loudspeakers, each of which subtends an angle of approximately 30° from the mid-line at the listener's ears, and so the 30° air-to-ear transfer functions have been chosen. It is important to note, however, that sound recorded by the apparatus described may equally well be perceived as three-dimensional whether played back through either headphones or loudspeakers—substantially independent of whichever transfer functions have been chosen to equalise the signals. It must also be realised that the air-to-ear transfer functions used on signals provided by the further microphones in order to provide the binaural synthesis are dictated by $\theta$ and $\phi$.

It will be understood that, although in the above description three further microphones spaced from the artificial head have been described—one in particular—the present invention is equally applicable with a considerable number of additional microphones, so long as the signal from each is subjected to the necessary time-delays and binaural synthesis before being combined with the signals provided by the artificial head.

Whilst in the above example, the signal processor 28 has been described as comprising a plurality of individual signal processing components, e.g. time delay 30, filters 34,40,42 adders 48,50, transaural crosstalk compensator 56, it will be appreciated by those skilled in the art that the signal processor 28 may itself take the form of a software controlled item, such as a digital processing engine, thereby obviating the need for a plurality of discrete components.

It will be apparent that the said transfer functions can be derived both by measurements on artificial heads and also on real human heads.

Furthermore, although in the above description, 30° has been given as the primary example of the angle subtended at the head 2 by the loudspeakers, it will be apparent that any suitable angle may be equally well employed.

Those skilled in the art will appreciate that by the term artificial head is meant any apparatus capable of mimicking the auditory responses characteristic of a human listener. Thus the term also covers, for example, a real human head with microphones mounted within the ear canals. This is because the processing as described hereabove is then performed on the signals provided by the microphones in the same way as if the microphones had been mounted within, say, a wooden or plastics head.

We claim:

1. A plural-channel sound processing apparatus comprising:

an artificial head having microphones in each ear for providing a left channel signal and a right channel signal representative of sound received by the microphones;

at least one further microphone spaced from the artificial head for providing monophonic further signals representative of sound received thereby; and a signal processing means for modifying the left channel signal and the right channel signal in accordance with air-to-ear transfer functions of the artificial head to produce respective left and right channel auxiliary signals; time-delaying the further signals from the at least one further microphone in dependence upon a displacement of the at least one further microphone from the artificial head; performing binaural synthesis on the time-delayed further signals to produce left channel further signals and right channel further signals; combining the left channel auxiliary signal with the left channel further signals and the right channel auxiliary signal with the right channel further signals; and transaural crosstalk compensating the respective combined signals to produce left and right channel processed signals.

2. An apparatus according to claim 1 wherein the displacement of the at least one further microphone from the artificial head comprises a distance (d) from and azimuthal (θ) and elevation (ϕ) angles to a point on a center line through the head centrally between the ears whilst the head is in a predetermined orientation.

3. An apparatus according to claim 1 wherein the signal processing means includes means for combining left channel signal components and for combining right channel signal components.

4. An apparatus according to claim 1 wherein the signal processing means comprises:

a first filter means for modifying the left and right channel signals in accordance with air-to-ear transfer functions of the artificial head; a time delay means for delaying the further signals from the at least one further microphone; a second filter means for performing said binaural synthesis; an adder means for combining the left channel auxiliary signal with the left channel further signals and the right channel auxiliary signal with the right channel further signals; and a transaural crosstalk compensator.

5. An apparatus according to claim 1 wherein the signal processing means includes means for performing a normalised binaural synthesis.

6. Use of the apparatus according to claim 1 for recording or transmitting sound.

7. A plural-channel sound processing apparatus comprising:

an artificial head having microphones in each ear for providing a left channel signal and a right channel signal representative of sound received by the microphones;

at least one further microphone spaced from the artificial head for providing monophonic further signals representative of sound received thereby; and a signal processing means for time delaying the further signals from the at least one further microphone in dependence upon a displacement of the at least one further microphone from the artificial head; performing binaural synthesis on the time-delayed further signals to produce left channel further signals and right channel further signals; combining the left channel signal with the left channel further signals and the right channel signal with the right channel further signals; modifying the combined signals in accordance with air-to-ear transfer functions of the artificial head; and transaural crosstalk compensating the respective modified signals to produce left and right channel processed signals.

8. An apparatus according to claim 7 wherein the signal processing means includes means for combining left channel signal components and for combining right channel signal components.

9. An apparatus according to claim 7 wherein the signal processing means comprises:

a first filter means for modifying the left and right channel signals in accordance with air-to-ear transfer functions of the artificial head; a time delay means for delaying the further signals from the at least one microphone; a second filter means for performing the binaural synthesis; an adder means for combining signals; and a transaural crosstalk compensator.

10. An apparatus according to claim 7 wherein the signal processing means includes means for performing a normalised binaural synthesis.

11. An apparatus according to claim 7, wherein the displacement of the at least one further microphone from the artificial head comprises a distance (d) from azimuthal (θ) and elevation (ϕ) angles to a point on a center line through the head centrally between the ears whilst the head is in a predetermined orientation.

12. A method of plural-channel sound processing including:

providing, from an artificial head, left and right first channel signals representative of sound received by the head;

providing, from at least one microphone spaced from the head, monophonic further signals representative of sound received thereby;

modifying the first channel signals in accordance with air-to-ear transfer functions of the artificial head to produce left and right channel auxiliary signals;

time-delaying the further signals from the at least one microphone in dependence upon a displacement of the at least one microphone from the artificial head;

performing binaural synthesis on the time-delayed further signals to produce left and right channel further signals;

combining the left channel auxiliary signal with the left channel further signals and combining the right channel auxiliary signal with the right channel further signals; and transaural crosstalk compensating and combining the respective combined signals to produce left and right channel processed signals.

13. Use of the method according to claim 12 for recording or transmitting sound.

14. A method of plural-channel sound processing including:

providing, from an artificial head, left and right channel first channel signals representative of sound received by the head;

providing, from at least one microphone spaced from the head, monophonic further signals representative of sound received thereby;

time-delaying the further signals from the at least one microphone in dependence upon a displacement of the at least one microphone from the artificial head;

performing binaural synthesis on the time-delayed further signals to produce left and right channel auxiliary further signals;

combining the left channel first channel and left channel auxiliary further signals together and combining the right channel first channel and right channel auxiliary further signals together;

modifying the combined signals in accordance with air-to-ear transfer functions of the artificial head; and transaural crosstalk compensating the respective modified signals to produce left and right channel processed signals.

15. Use of the method according to claim 14, for recording or transmitting sound.

* * * * *